US006542617B1

(12) United States Patent
Fujihira et al.

(10) Patent No.: US 6,542,617 B1
(45) Date of Patent: Apr. 1, 2003

(54) SPEAKER

(75) Inventors: Masao Fujihira, Kanagawa (JP); Kenji Tokushige, Tokyo (JP); Ikuo Shinohara, Tokyo (JP)

(73) Assignee: Sony Corporation, Tokyo (JP)

( * ) Notice: Subject to any disclaimer, the term of this patent is extended or adjusted under 35 U.S.C. 154(b) by 0 days.

(21) Appl. No.: 09/578,386

(22) Filed: May 25, 2000

(30) Foreign Application Priority Data

May 26, 1999 (JP) ..... 11-146771

(51) Int. Cl.[7] ..... H04R 25/00
(52) U.S. Cl. ..... 381/402; 381/407; 381/400
(58) Field of Search ..... 381/400, 401, 381/402, 407, 410

(56) References Cited

U.S. PATENT DOCUMENTS 4,479,035 A * 10/1984 Philippbar ..... 381/409
4,783,824 A * 11/1988 Kobayashi ..... 381/402
5,717,775 A * 2/1998 Sakamoto et al. ..... 381/400

FOREIGN PATENT DOCUMENTS

| | | | |
|---|---|---|---|
| DE | 3844702 | 4/1991 | ..... H04R/3/08 |
| EP | 0409429 | 1/1991 | ..... H04R/9/06 |
| JP | 9238389 | 9/1997 | ..... H04R/1/24 |

* cited by examiner

*Primary Examiner*—Sinh Tran
(74) *Attorney, Agent, or Firm*—Jay H. Maioli

(57) ABSTRACT

In a speaker which is constructed in a manner that a voice coil bobbin is attached to an inner circumferential portion of a cone type diaphragm while a voice coil is wound around the voice coil bobbin, and the voice coil is inserted into a magnetic gap, the voice coil bobbin is formed of a conductive material while the voice coil being fixed is the voice coil bobbin by a soft bonding agent, and in a very high range, the voice coil is operated as a driving coil while the voice coil bobbin is operated as a short coil.

4 Claims, 6 Drawing Sheets

SPEAKER

BACKGROUND OF THE INVENTION

1. Field of the Invention

The present invention relates to a wide-band reproducing speaker which can reproduce a very high range of frequencies up to 70 kHz, for example.

2. Description of the Related Art

In general, a whole band speaker having a small aperture (diameter), for example, an aperture of 39 mm, is constructed in a manner that a voice coil bobbin is attached to an inner circumferential portion of a diaphragm comprising a paper cone while a voice coil is wound around the voice coil bobbin, and the voice coil is inserted into a magnetic gap. However, in the above speaker, it is difficult to reproduce a very high range, and further, a reproducing range by the speaker is up to 40 kHz to utmost because a weight of the voice coil is heavy.

The present invention has been made in view of the above problem. It is, therefore, an object of the present invention to provide a cone type speaker which can reproduce a very high range up to 70 kHz, for example.

SUMMARY OF THE INVENTION

To achieve the above object, the present invention provides a speaker which is constructed in a manner that a voice coil bobbin is attached to an inner circumferential portion of a cone type diaphragm while a voice coil is wound around the voice coil bobbin, and the voice coil is inserted into a magnetic gap, characterized in that the voice coil bobbin is formed of a conductive material while the voice coil being fixed to the voice coil bobbin by a soft bonding agent, and in a very high range, the voice coil is operated as a driving coil while the voice coil bobbin being operated as a short coil.

According to the present invention, in low, mid and high ranges, a diaphragm comprising a cone paper is driven by the voice coil like an ordinary speaker up to 40 kHz. In the present invention, the voice coil is fixed to the voice coil bobbin by a soft bonding agent; therefore, in a very high range of voice, a bonding strength of the soft bonding agent lowers. As a result, the voice coil bobbin and the voice coil become a state of separating from each other, and then, constitutes an electromagnetic induction type speaker such that the voice coil is operated as a driving coil while the voice coil bobbin formed of a conductive material being operated as a short coil. Thus, the diaphragm is driven by a vibration of a very light voice coil bobbin, and the voice coil before separating from the voice coil bobbin has no mass, and therefore, by a difference in mass, it is possible to reproduce a very high range up to 70 kHz, for example.

DESCRIPTION OF THE PREFERRED EMBODIMENTS

Embodiments of a speaker according to the present invention will be described below with reference to FIG. 1 and FIG. 2.

Figure 2:
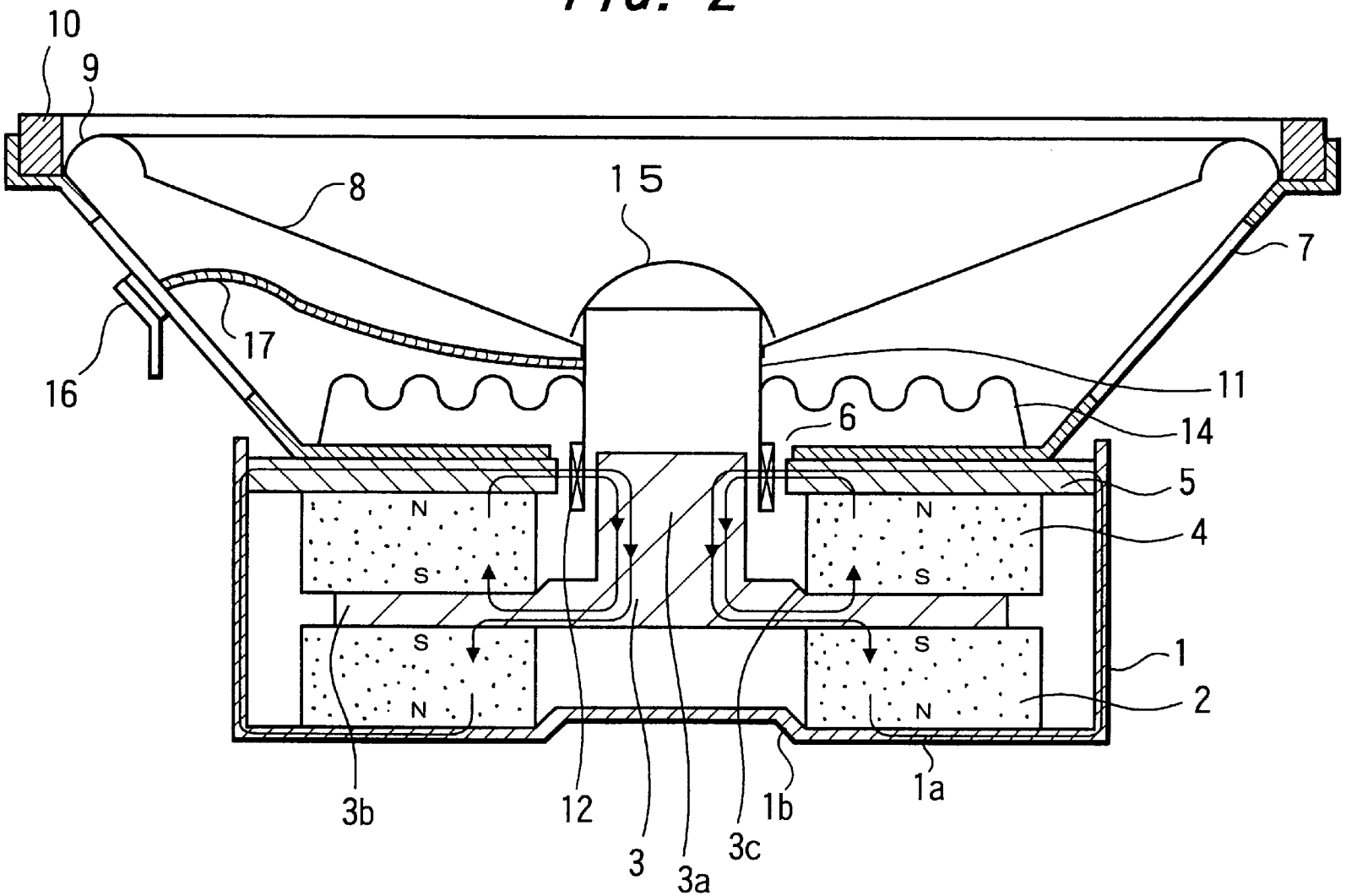
FIG. 2 is a cross sectional view showing an embodiment of the speaker of the present invention.

In the example shown in FIG. 2, a ring-like magnet 2 has an N pole and an S pole which are magnetized in a thickness direction on a bottom portion la of a pot-shaped shield cover and yoke 1 having a predetermined size, and the ring-like magnet 2 is bonded and fixed so that the N pole is abutted against the bottom portion 1*a* of a pot-shaped shield cover and yoke 1. In this case, the ring-like magnet 2 is positioned by a magnet guide 1*b* provided on the bottom portion 1*a* of the pot-shaped shield cover and yoke 1.

A yoke 3 is constructed in a manner that a center pole 3*a* and a flange 3*b* are integrally formed, and the yoke 3 is fixed on the S pole of the ring-like magnet 2 so that a bottom surface of the flange 3*b* of the yoke 3 is abutted against the S pole.

Further, a ring-like magnet 4 has an N pole and an S pole which are magnetized in a thickness direction on the flange 3*b* of the yoke 3, and the ring-like magnet 4 is bonded and fixed so that the S pole is abutted against the flange 3*b* of the yoke 3. In this case, the center pole 3*a* of the yoke 3 penetrates through the ring-like magnet 4, and then, the ring-like magnet 4 is positioned by a magnet guide 3*c* provided on the flange 3*b* of the yoke 3.

A ring-like plate 5 is bonded and fixed on the N pole of the ring-like magnet 4 so that a magnetic gap 6 is formed between an inner peripheral surface of the plate 5 and an outer peripheral surface of the center pole 3*a*. Moreover, an outer periphery of the plate 5 is abutted against an inner peripheral surface on the upper end of a side wall of the pot-shaped shield cover and yoke 1.

In this case, these ring-like magnets 2 and 4 are mutually magnetized in a reverse direction, and then, the ring-like magnet 2 functions as a cancel magnet while the pot-like shield cover and yoke 1 covers the outer periphery of the ring-like magnets 2 and 4, and thereby, a magnetic shield type speaker is constructed.

Moreover, a speaker frame 7 is attached to an upper surface of the plate 5, and then, a cone type diaphragm 8 having an edge 9 at its outer periphery is retained to an outer peripheral portion of the frame 7 by a gasket 10.

On the other hand, a voice coil bobbin 11 is attached to an inner peripheral portion of the diaphragm 8, and then, a voice coil 12 is wound around the voice coil bobbin 11 while being bonded and fixed thereto. Further, the voice coil 12 is inserted into the magnetic gap 6 formed between the inner peripheral surface of the plate 5 and the outer peripheral surface of the center pole 3*a* of the yoke 3.

Figure 1:
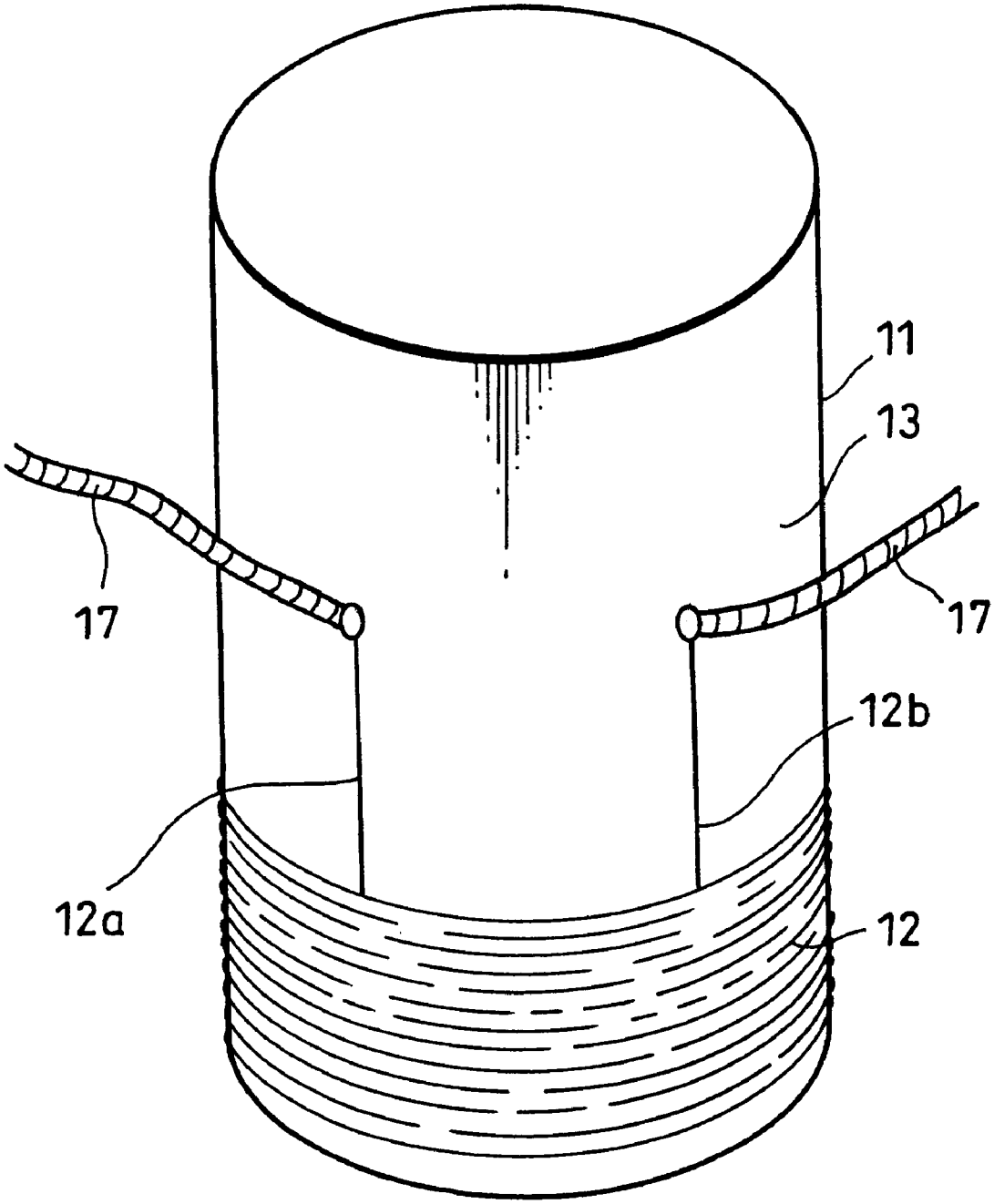
FIG. 1 is a perspective view showing an example of a voice coil used in a speaker of the present invention.

In this embodiment, as shown in FIG. 1, the voice coil bobbin 11 is formed a conductive material, e.g., an aluminum sheet (thin film), and the entire range of the voice coil bobbin 11 is in a conductive (short) state.

A reinforcing tape 13 for reinforcing the voice coil bobbin 11 is wound around the outer periphery of the voice coil bobbin 11 comprising, e.g., an aluminum thin film, and then, the voice coil 12 is wound around the voice coil bobbin 11, and further, is bonded and fixed thereto. In FIG. 1, 12*a* and 12*b* are individually voice coil lead wires for supplying an acoustic signal of the voice coil 12. Moreover, a reference numeral 17 denotes a cotton-covered wire, and the cotton-covered wire 17 has one end connected to an input terminal 16 to which an acoustic signal is inputted, and the other end bonded and fixed on the reinforcing tape 13. The other ends of two cotton-covered wires 17 are individually soldered to the voice coil lead wires 12*a* and 12*b*.

In this embodiment, a soft bonding agent is used as a bonding agent for bonding and fixing the voice coil 12 to the voice coil bobbin 11. An alcoholic reactivated bonding agent such as a rock varnish is used as the soft bonding agent.

Moreover, as shown in FIG. 2, the voice coil 12 is retained in the magnetic gap 6 by a damper 14. A spiral damper is used as the damper 14, and is constructed in a manner that, e.g., a cloth is impregnated with a synthetic resin. Further, a dustproof cap 15 is provided so as to cover the upper surface of the voice coil bobbin 11.

The input terminals 16 is provided on a predetermined position of the speaker frame 7, and then, an acoustic signal supplied to the input terminal 16 is supplied to the voice coil 12 via a cotton-covered wire 17.

In the speaker shown in FIG. 2, a magnetic flux of the N pole of the ring-like magnet 4 flows through the following magnetic circuit of; more specifically, the N pole of the ring-like magnet 4→the plate 5→the magnetic gap 6→the center pole 3*a* of the yoke 3→the flange 3*b*→the S pole of the ring-like magnet 4.

Moreover, magnetic flux of the N pole of the ring-like magnet 2 flows through the following magnetic circuit of; more specifically, the N pole of the ring-like magnet 2→the bottom portion 1*a* of the shield cover and yoke 1→the side wall the plate 5→the magnetic gap 6→the center pole 3*a* of the yoke 3→the flange 3*b*→the S pole of the ring-like magnet 2.

Therefore, when an acoustic signal is supplied from the input terminal 16 to the voice coil 12, in response to the acoustic signal, the voice coil 12 is driven so as to drive the diaphragm 8. In this case, the diaphragm 8 is driven by the voice coil 12 up to, e.g., about 40 kHz.

Figure 3:
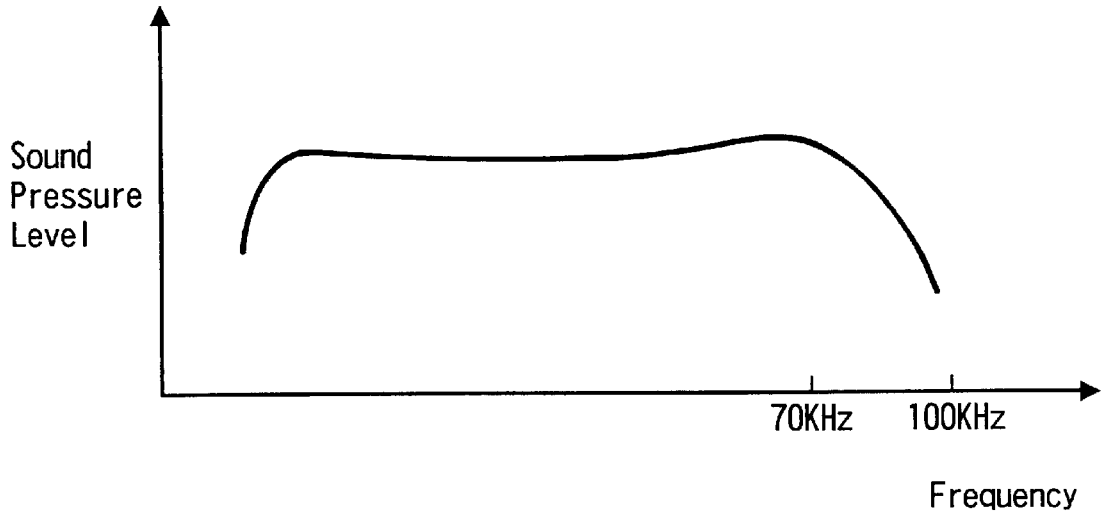
FIG. 3 is a diagram to explain the present invention.

In this embodiment, the voice coil bobbin 11 is formed of a conductive material, e.g., an aluminum thin film (sheet), and further, the voice coil 12 is fixed to the voice coil bobbin 11 by a soft bonding agent. For example, in a very high range of 40 kHz or more, a bonding strength of the soft bonding agent lowers; as a result, the voice coil bobbin 11 and the voice coil 12 become a state of separating from each other. At this time, the voice coil bobbin 11 and the voice coil 12 constitute an electromagnetic induction type speaker such that the voice coil 12 is operated as a driving coil, and the voice coil bobbin 11 formed of the aluminum thin film is operated as a short coil. Therefore, the diaphragm 8 is vibrated by only very light voice coil bobbin 11, and then, the voice coil 12 before separating from the voice coil bobbin 11 has no mass. By the difference in mass, it is possible to obtain a speaker which can reproduce a very high range up to, e.g., 70 kHz having a sound pressure-level frequency characteristic as shown in FIG. 3.

Figure 4:
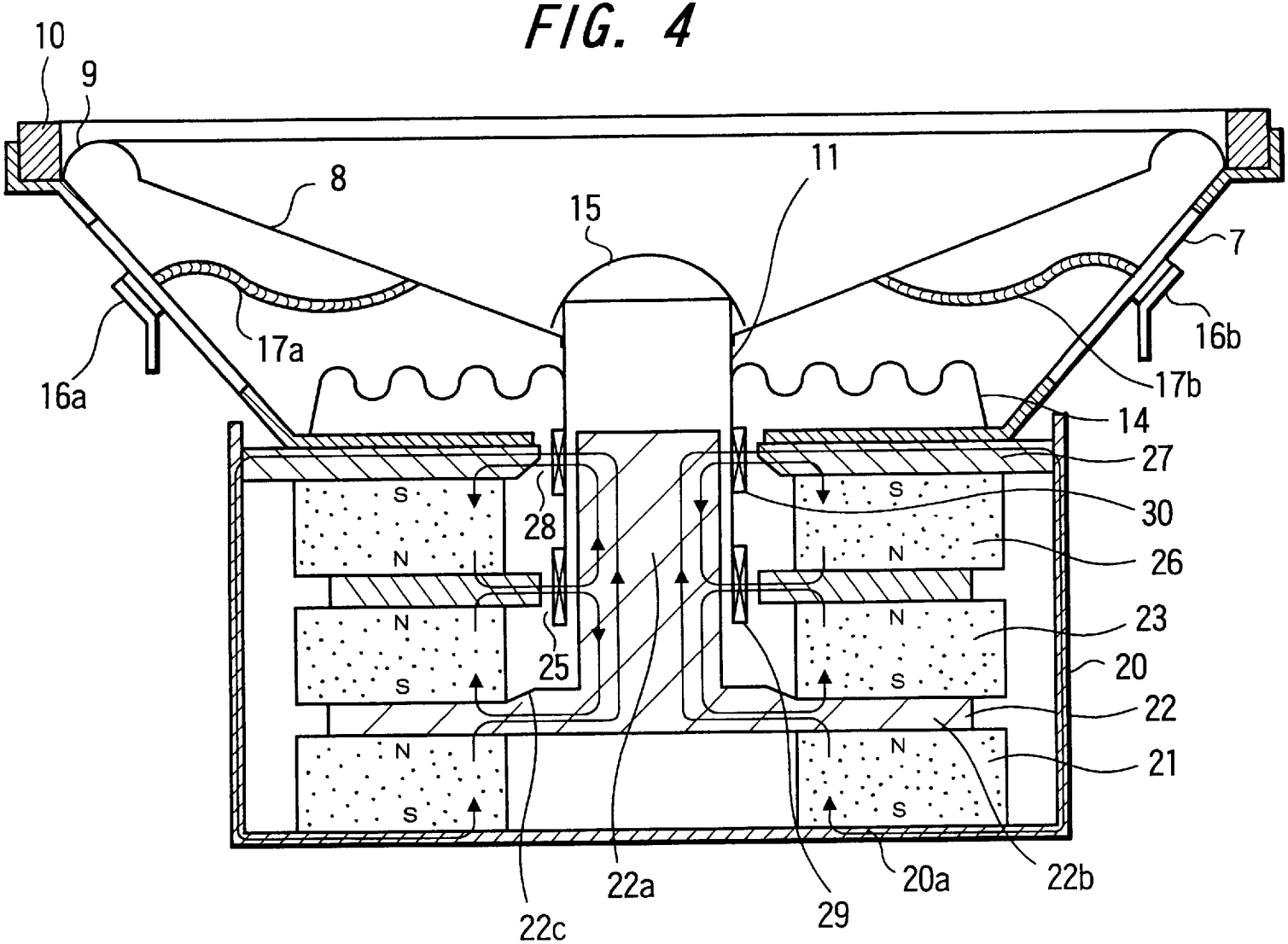
FIG. 4 is a cross sectional view showing another example of the speaker of the present invention.

FIG. 4 shows another embodiment of the speaker according to the present invention. In the case of explaining FIG. 4, in FIG. 4, like reference numerals are used to designate the portions corresponding to FIG. 2, and the details are omitted.

In the example shown in FIG. 4, a ring-like magnet 21 has an N pole and an S pole which are magnetized in a thickness direction, on the central portion of a bottom portion 20*a* of a pot-shaped shield cover and yoke 20 having a predetermined size and the ring-like magnet 21 is bonded and fixed so that the S pole is abutted against the bottom portion 20*a* of a pot-shaped shield cover and yoke 20.

A yoke 22 is constructed in a manner that a center pole 22*a* and a flange 22*b* are integrally formed, and the yoke 22 is fixed on the N pole of the ring-like magnet 21 so that a bottom surface of the flange 22*b* of the yoke 22 is abutted against the N pole.

Further, a ring-like magnet 23 has an N pole and an S pole which are magnetized in a thickness direction on the flange 22*b* of the yoke 22, and the ring-like magnet 23 is bonded and fixed so that the S pole is abutted against the flange 22*b* of the yoke 22. In this case, the center pole 22*a* of the yoke 22 penetrates through the ring-like magnet 23, and then, the ring-like magnet 23 is positioned by a magnet guide 22*c* provided on the flange 22*b* of the yoke 22.

A ring-like plate 24 is bonded and fixed on the N pole of the ring-like magnet 23 so that a magnetic gap 25 is formed between an inner peripheral surface of the plate 24 and an outer peripheral surface of the center pole 22*a*.

Moreover, a ring-like magnet 26 has an N pole and an S pole which are magnetized in a thickness direction on the plate 24, and the ring-like magnet 26 is bonded and fixed so that the N pole is abutted against the plate 24. In this case, the center pole 22*a* of the yoke 22 penetrates through the ring-like magnet 26. These ring-like magnets 26 and 23 are magnetized in a reverse to each other.

A ring-like plate 27 is bonded and fixed on the S pole of the ring-like magnet 26 so that a magnetic gap 28 is formed between an inner peripheral surface of the plate 27 and an outer peripheral surface of the center pole 22*a*. In this case, the inner peripheral side of the plate 27 is tapered so that a magnetic flux is collected in the magnetic gap 28. Moreover, the outer peripheral surface of the plate 27 is abutted against an inner peripheral surface on the upper end of the side wall of the spot-like shield cover and yoke 1.

In this case, each magnetic flux of the ring-like magnets 21, 23 and 26 flows through the shield cover and yoke 20, the yoke 22, and the plates 24 and 27; therefore, a leakage flux is less, and a magnetic shield type speaker is constructed.

Moreover, the speaker frame 7 is attached onto the upper surface of the plate 27, and an outer peripheral portion of the cone type diaphragm 8 having an edge 9 is retained to an outer periphery of the frame 7 by a gasket 10.

On the other hand, the voice coil bobbin 11 is attached to an inner peripheral portion of the diaphragm 8, and the mid-low range voice coil 29 and the mid-high range voice coil 30 are individually wound around the voice coil bobbin 11, and then, are bonded and fixed thereto. The mid-low range voice coil 29 is inserted into the magnetic gap 25 formed between the inner peripheral surface of the plate 24 and the outer peripheral surface of the center pole 22*a* of the yoke 22; on the other hand, the mid-high range voice coil 30 is inserted into the magnetic gap 28 formed between the inner peripheral surface of the plate 27 and the outer peripheral surface of the center pole 22*a* of the yoke 22.

Figure 5:
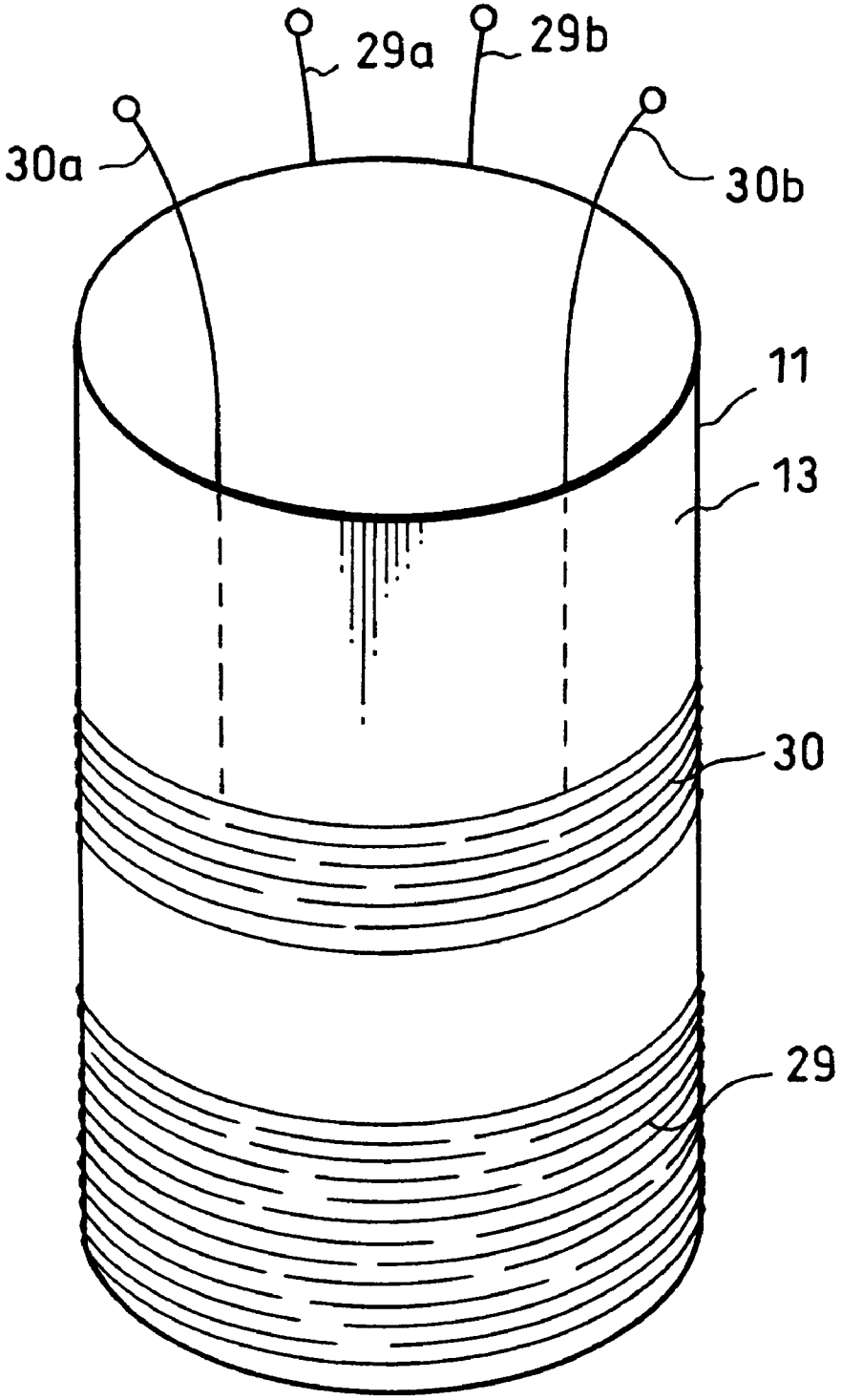
FIG. 5 is a perspective view showing an example of a voice coil used in the speaker shown in FIG. 4.

In the example of FIG. 4, as shown in FIG. 5, the voice coil bobbin 11 is formed of a conductive material, e.g., an aluminum thin film so that the entire range of the voice coil bobbin 11 is in a conductive (short) state.

A reinforcing tape 13 for reinforcing the voice coil bobbin 11 is wound around the outer peripheral surface of the voice coil bobbin 11 formed of, e.g., an aluminum thin film, and the mid-low range voice coil 29 and the mid-high range voice coil 30 are individually wound around the voice coil bobbin 11, and then, are bonded and fixed thereto. In FIG. 5, reference numerals 29*a* and 29*b* are voice coil lead wires for supplying an acoustic signal of the mid-low range voice coil 29, and 30*a* and 30*b* are voice coil lead wires for supplying an acoustic signal of the mid-high range voice coil 30.

In the examples of FIG. 4 and FIG. 5, a soft bonding agent is used as a bonding agent for bonding and fixing the mid-low range voice coil 29 and the mid-high range voice coil 30 to the voice coil bobbin 11. For example, an alcoholic reactivated agent such as a rock varnish is used as the soft bonding agent.

Moreover, in the example of FIG. 4, the mid-low range voice coil 29 and the mid-high range voice coil 30 are individually retained in the magnetic gaps 25 and 28 by using a damper 14. Further, a dustproof cap 15 is provided so as to cover the upper surface of the voice coil bobbin 11.

Moreover, the input terminals 16*a* and 16*b* is provided on a predetermined position on the speaker frame 7, and then, the acoustic signal supplied to the input terminal 16*a* is supplied to the mid-low range voice coil 29 via a cotton-covered wire 17*a* while the acoustic signal supplied to the input terminal 16*b* being supplied to the mid-high range voice coil 30 via a cotton-covered wire 17*b*.

In this case, each magnetic flux of the magnetic gaps 25 and 28 is mutually inverted in its direction; for this reason, the acoustic signals supplied to the input terminals 16*a* and 16*b* are mutually inverted in there polarity, and the acoustic signal is supplied to the input terminal 16*b* via a capacitor constituting a low-pass cut filter. In this case, the winding direction of the mid-low range voice coil 29 and the mid-high range voice coil 30 are mutually inverted, and then, the acoustic signal having the same polarity may be supplied.

In the speaker shown in FIG. 4, a magnetic flux of the N pole of the ring-like magnet 21 flows through the following magnetic circuit of; more specifically, the N pole of the ring-like magnet 21→the flange 22*b* of the yoke 22→the center pole 22*a*→the magnetic gap 28→the plate 27→the side wall of the shield cover and yoke 20→the bottom portion 20*a*→the S pole of the ring-like magnet 21.

Moreover, a magnetic flux of the N pole of the ring-like magnet 23 flows through the following magnetic circuit of; more specifically, the N pole of the ring-like magnet 21→the plate 24→the magnetic gap 25→the center pole 22*a* of the yoke 22→the flange 22*b*→the S pole of the ring-like magnet 23.

A magnetic flux of the N pole of the ring-like magnet 26 flows through the following magnetic circuit of; more specifically, the N pole of the ring-like magnet 26→the plate 24→the magnetic gap 25→the center pole 22*a* of the yoke 22→the magnetic gap 28→the plate 27→the S pole of the ring-like magnet 26.

Therefore, when an acoustic signal of high, mid and low ranges is supplied from the input terminals 16*a* and 16*b* to the mid-low range voice coil 29 and to the mid-high range voice coil 30, respectively, in response to the acoustic signal, the mid-low range voice coil 29 and the mid-high range voice coil 30 are driven so as to drive the diaphragm 8. In this case, the diaphragm 8 is driven up to, e.g., about 40 kHz by the mid-low range voice coil 29 and the mid-high range voice coil 30.

In this embodiment, the voice coil bobbin 11 is formed of a conductive material, e.g., an aluminum thin film (sheet), and further, the mid-low range voice coil 29 and the mid-high range voice coil 30 are fixed to the voice coil bobbin 11 by a soft bonding agent. For example, when a very high range of 40 kHz or more is supplied, a bonding strength of the soft bonding agent lowers; as a result, the voice coil bobbin 11 and the voice coils 29 and 30 become a state of separating from each other. At this time, the voice coil bobbin 11 and these voice coils 29 and 30 constitute an electromagnetic induction type speaker such that voice coils 29 and 30 are operated as a driving coil, and the voice coil bobbin 11 comprising an aluminum thin film is operated as a short coil. Thus, the diaphragm 8 is vibrated by only very light voice coil bobbin 11, and therefore, by the difference in mass, it is possible to obtain a speaker which can reproduce a very high range up to, e.g., 70 kHz having a sound pressure level-frequency characteristic as shown in FIG. 3.

Figure 6:
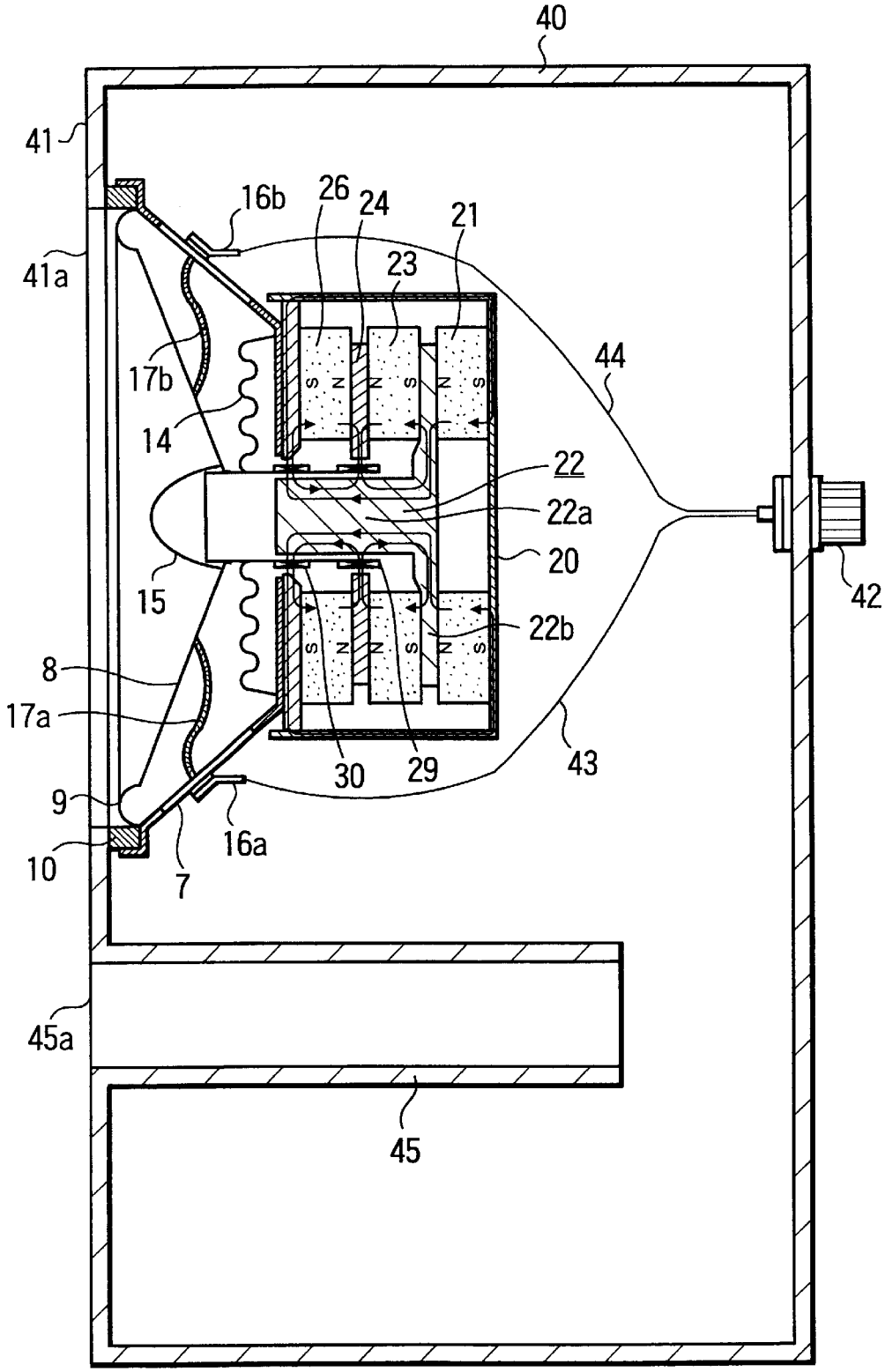
FIG. 6 is a cross sectional view showing an example of a speaker unit.

FIG. 6 shows a phase reverse type speaker unit which is constructed of attaching a wide-band reproducing speaker as shown in FIG. 4, which can reproduce a very high range up to, e.g., 70 kHz, to a small-size speaker box 40. In the case of explaining the example of FIG. 6, in FIG. 6, the speaker shown in FIG. 4 is fixed so as to face a speaker radiation hole 41*a* which is formed in a baffle plate 41 located on the front side of a speaker box 40 which is formed like a substantially rectangular box, and is made of an ABS resin or the like.

Moreover, an acoustic signal is supplied to the input terminals 16*a* and 16*b* of the speaker via connecting wires 43 and 44 by an input terminal 42 located at a predetermined position on the outside of the speaker box 40, and further, the acoustic signal from the input terminal 16*a* is supplied to the mid-low range voice coil 29 via a cotton-covered wire 17*a* while the acoustic signal obtained from the input terminal 16*b* being supplied to the mid-high range voice coil 30 via a cotton-covered wire 17*b*.

A duct 45 having an opening 45*a* is provided on the identical surface to the speaker sound radiation hole 41*a* of the baffle plate 41, and thereby, a sound produced from a back side of the diaphragm 8 of the speaker is inverted in its phase, and then, is radiated to the outside of the speaker box 40 from the duct 45.

In this case, a sound produced from a back side of the diaphragm 8 of the speaker is inverted in its phase, and then, is radiated to the outside of the speaker box 40 from the duct 45, and thereby, it is possible to widen a low range of a sound produced from the front side of the diaphragm 8.

According to the speaker unit of this embodiment, it is possible to obtain a wide-band reproducing speaker unit which has a small size, and can reproduce a very high range up to, e.g., 70 kHz.

The present invention is not limited to the above embodiments, and of course, other various constructions may be employed without diverging from the scope of the invention.

Having described preferred embodiments of the present invention with reference to the accompanying drawings, it is to be understood that the present invention is not limited to the above-mentioned embodiments and that various changes and modifications can be effected therein by one skilled in the art without departing from the spirit or scope of the present invention as defined in the appended claims.

What is claimed is:

1. A speaker constructed in a manner that a voice coil bobbin is attached to an inner circumferential portion of a cone type diaphragm while a voice coil is wound on the voice coil bobbin and inserted into a magnetic gap, wherein the voice coil bobbin is formed of an electrically conductive material and the voice coil is attached to the voice coil bobbin by a soft bonding agent, so that the diaphragm is driven by the voice coil bobbin having the voice coil attached thereto, wherein said soft bonding agent is selected so that in a high frequency range a bonding strength of said soft bonding agent is lowered, whereby said voice coil and said voice coil bobbin become unattached from each other and said voice coil drives said voice coil bobbin to move relative to said voice coil, so that the diaphragm is driven by the voice coil bobbin with the voice coil separated therefrom, whereby the speaker operates as an electromagnetic induction speaker.

2. The speaker as claimed in claim 1, wherein the voice coil bobbin is formed of sheet aluminum.

3. The speaker as claimed in claim 1, further comprising a reinforcing tape wound around an outer periphery of the voice coil bobbin and having the voice coil wound thereon.

4. The speaker as claimed in claim 1, wherein the voice coil comprises a first voice coil for connection to a mid-high range voice signal, and further comprising a second voice coil wound on the voice coil bobbin at a location separated from the first voice coil for connection to a mid-low range voice signal, wherein the second voice coil is also fixed to the voice coil bobbin by the soft bonding agent.

* * * * *